US008186805B2

(12) United States Patent
Su

(10) Patent No.: US 8,186,805 B2
(45) Date of Patent: May 29, 2012

(54) PRINTER AND WASTE INK COLLECTING DEVICE THEREOF

(75) Inventor: Liang-Ching Su, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 352 days.

(21) Appl. No.: 12/630,858

(22) Filed: Dec. 4, 2009

(65) Prior Publication Data

US 2011/0074876 A1 Mar. 31, 2011

(30) Foreign Application Priority Data

Sep. 29, 2009 (CN) ..... 2009 1 0308002

(51) Int. Cl.
*B41J 2/165* (2006.01)

(52) U.S. Cl. ..... 347/36

(58) Field of Classification Search ..... None
See application file for complete search history.

(56) References Cited

U.S. PATENT DOCUMENTS 4,701,771 A * 10/1987 Ikeda ..... 347/36
6,068,208 A * 5/2000 Matsuki et al. ..... 242/383.2
2003/0052940 A1 * 3/2003 Aldrich et al. ..... 347/36

* cited by examiner

*Primary Examiner* — Matthew Luu
*Assistant Examiner* — Justin Seo
(74) *Attorney, Agent, or Firm* — Altis Law Group, Inc.

(57) ABSTRACT

A waste ink collecting device includes a ratchet wheel defining a receiving groove for receiving waste ink, a detent, a reciprocatingly movable transmission pole, and immovable first and second poles. The detent includes a hook, and a main body defining elongated first, second and third holes. The second hole is between the first and third holes. The hook extends from the main body away from the first hole. The transmission pole extends into the first hole. The first pole extends into the second hole. A diameter of the first pole equals to a width of the second hole. The second pole extends into the third hole. A diameter of the second pole is smaller than a width of the third hole. When the transmission pole moves forward, the hook engages with and rotates the ratchet wheel. When the transmission pole moves backward, the hook moves away from the ratchet wheel.

13 Claims, 3 Drawing Sheets

PRINTER AND WASTE INK COLLECTING DEVICE THEREOF

BACKGROUND

1. Technical Field

The present disclosure relates to a printer and a waste ink collecting device of the printer.

2. Description of Related Art

A waste ink collecting device is commonly mounted in a printer, for receiving waste ink cleared from the print head. The waste ink cleared from the print head falls to land at the same point in the waste ink collecting device. Therefore, the waste ink may pile up at that point, which is a disadvantage.

DETAILED DESCRIPTION

Figure 1:
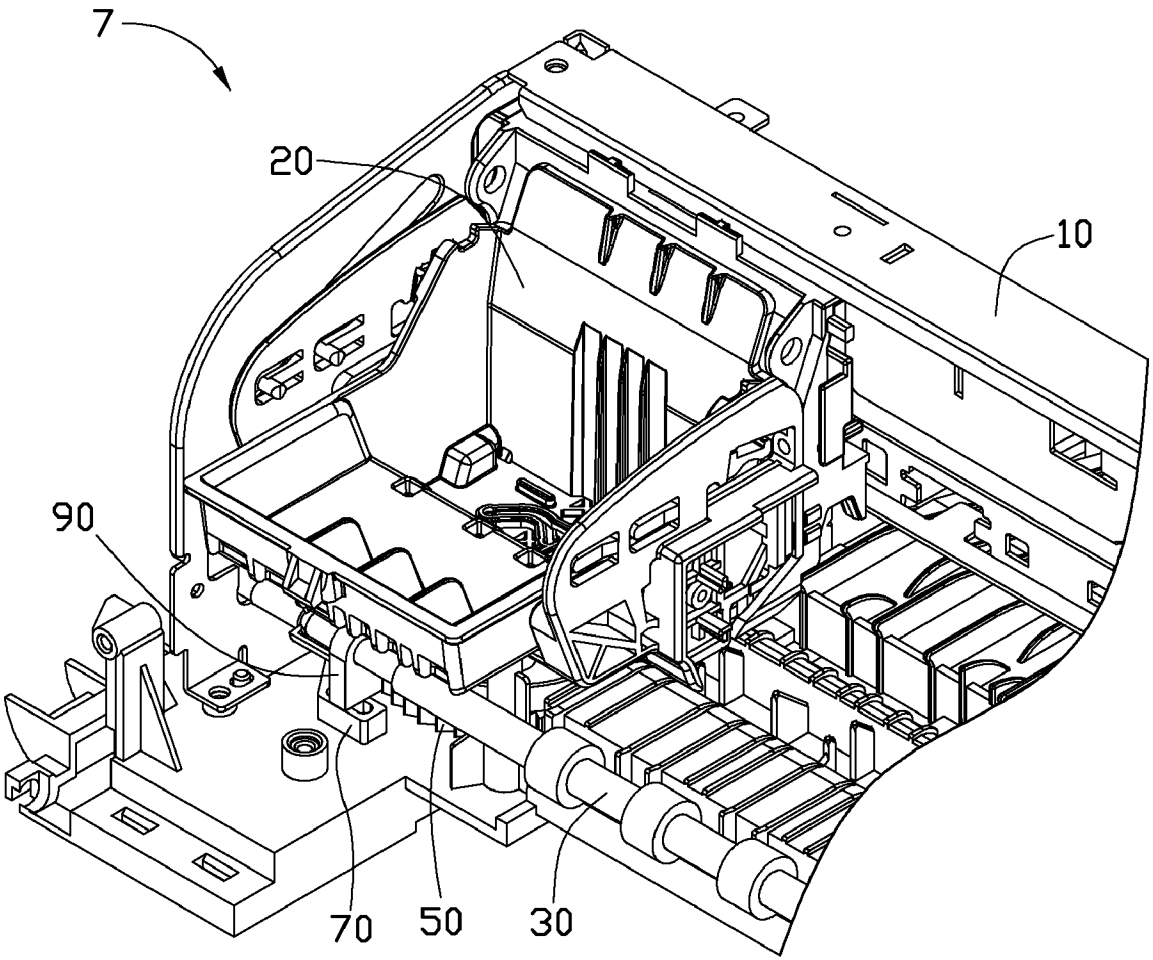
FIG. 1 is a partial, isometric view of an embodiment of a printer, the printer including an ink cartridge carrier and a waste ink collecting device.
Figure 2:
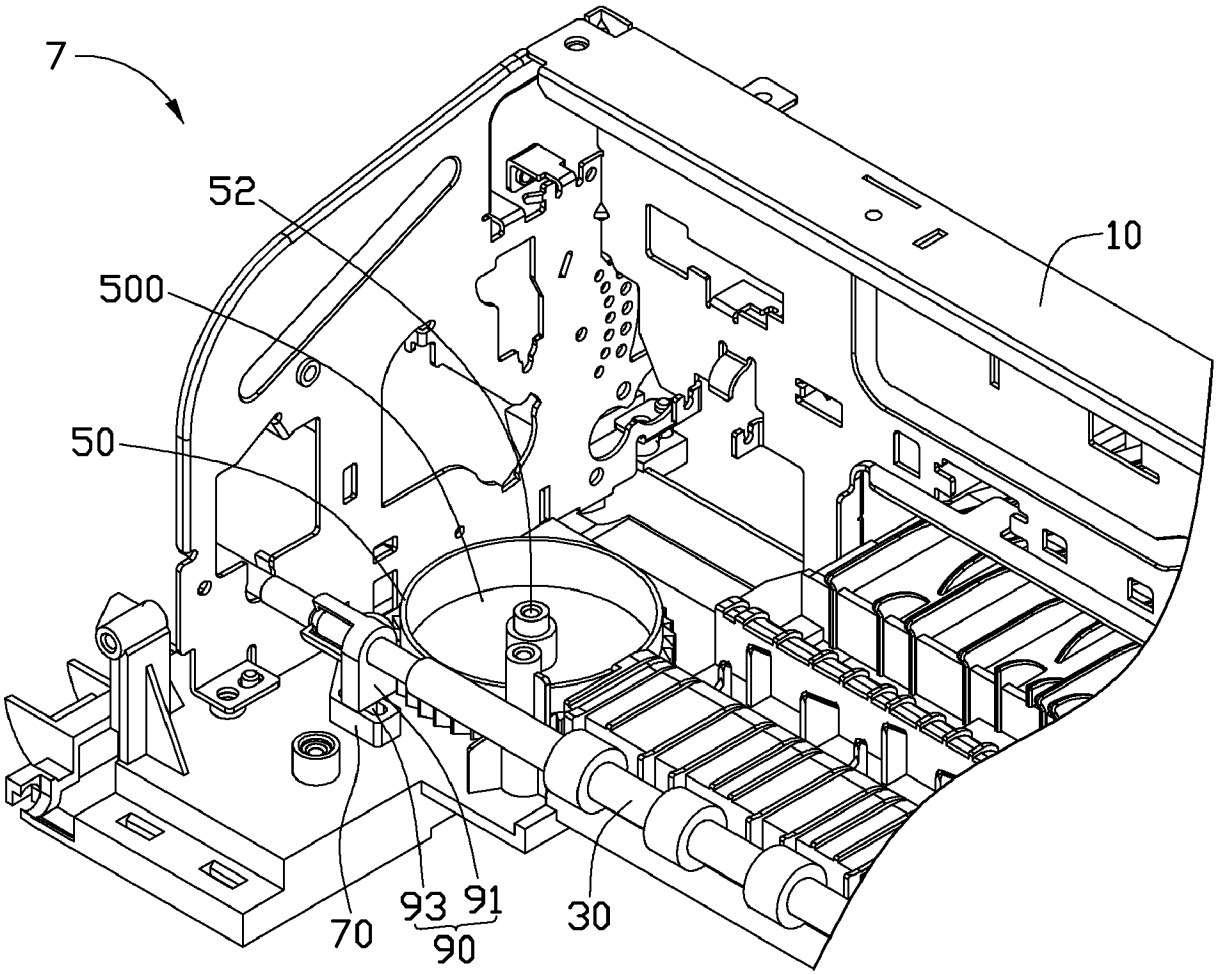
FIG. 2 is similar as FIG. 1, but omitting the ink cartridge carrier and exposing the waste ink collecting device.
Figure 3:
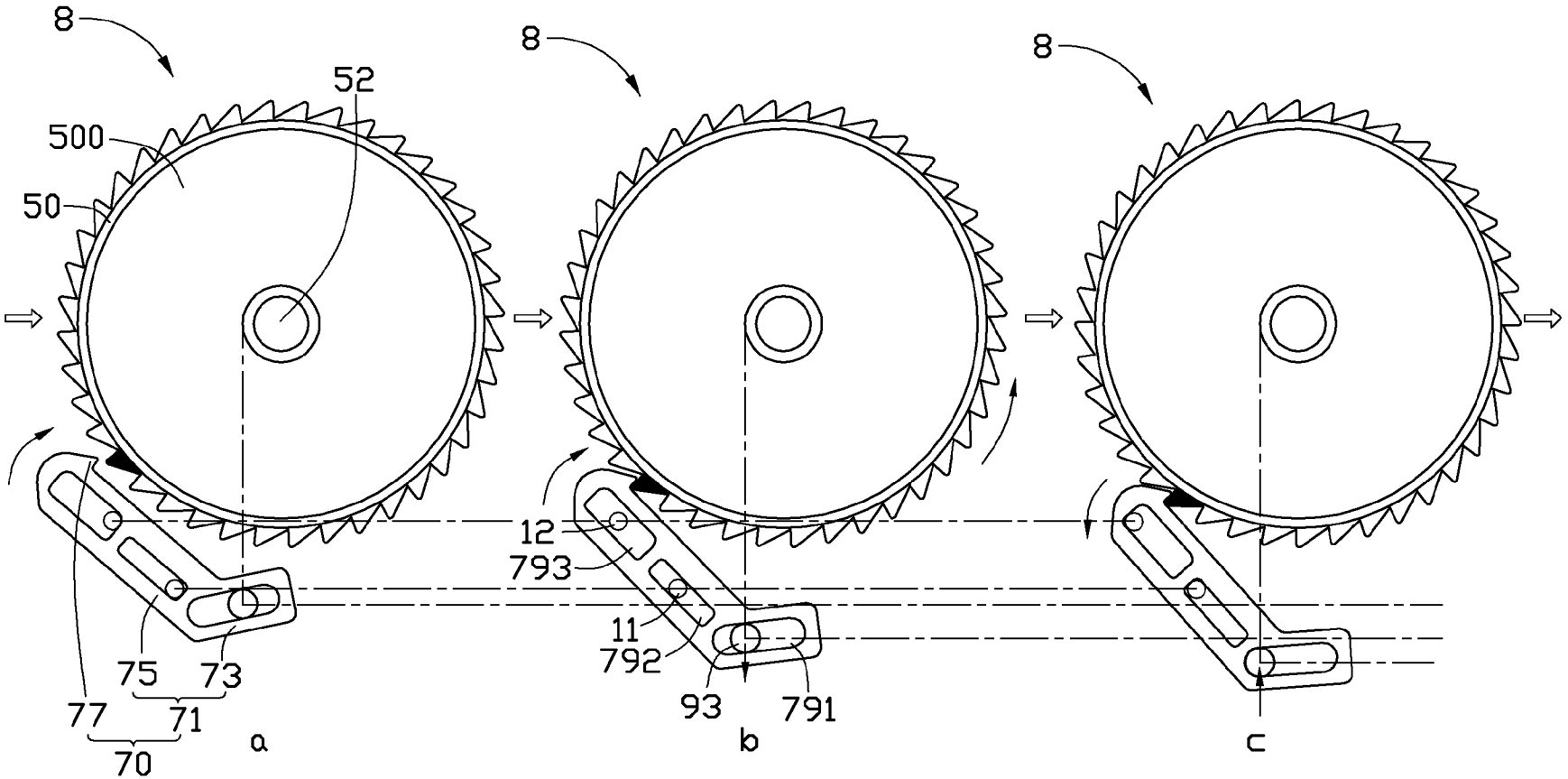
FIG. 3 is a sketch diagram showing working states of the waste ink collecting device in FIG. 2.

Referring to FIGS. 1 to 3, an embodiment of a printer 7 includes a waste ink collecting device 8, a frame 10, an ink cartridge carrier 20 mounted to the frame 10, and a transmission shaft 30 mounted to the frame 10. The ink cartridge carrier 20 is used to carry an ink cartridge (not shown). A print head (not show) is fixed to the ink cartridge carrier 20 or the ink cartridge. When the print head is timely cleaned automatically, waste ink cleared from the print head will fall into the waste ink collecting device 8. The transmission shaft 30 is able to be driven by a motor to do reciprocating rotation.

The waste ink collecting device 8 includes a ratchet wheel 50 rotatably mounted to the frame 10, a detent 70 movably mounted to the frame 10, and a transmission member 90 fixed to the transmission shaft 30.

The ratchet wheel 50 is located under the ink cartridge carrier 20. An annular receiving groove 500 is defined in the ratchet wheel 50, around an axis 52 of the ratchet wheel 50, to receive the waste ink.

The detent 70 is located under the transmission shaft 30. The detent 70 includes a main body 71 and a hook 77. The main body 71 includes an elongated short first block 73 and an elongated long second block 75. The second block 75 extends obliquely at an angle from an end of the first block 73. In one embodiment, an angle between the first block 73 and the second block 75 is an obtuse angle. An elongated first hole 791 is defined in and along a lengthwise direction of the first block 73. An elongated second hole 792 and an elongated third hole 793 are defined in and along a lengthwise direction of the second block 75, and are aligned. The second hole 792 is between the first hole 791 and the third hole 793. The third hole 793 is wider than the second hole 792. A first pole 11 extends upwards from the frame 10 into the second hole 792. A diameter of the first pole 11 is equal to a width of the second hole 792. A second pole 12 extends upwards from the frame 10 into the third hole 793. A diameter of the second pole 12 is smaller than a width of the third hole 793. The hook 77 extends from a distal end of the second block 75 away from the first block 73, towards the ratchet wheel 50.

The transmission member 90 includes a mounting portion 91 fixed to the transmission shaft 30, and a transmission pole 93 extending from the mounting portion 91 into the first hole 791 of the detent 70. The transmission member 90 is able to swing via the rotation of the reciprocating rotation of the transmission shaft 30.

Referring to FIG. 3, three working states a, b, and c of the waste ink collecting device 8 are shown. The transmission shaft 30 is driven to do the reciprocating rotation, and therefore the transmission member 90 is reciprocatingly swung. When the transmission pole 93 of the transmission member 90 is swung downward, the transmission pole 93 drives the detent 70 to rotate clockwise about the first pole 11, to make the hook 77 of the detent 70 engage with the ratchet wheel 50 (see the working states a to b) and drive the ratchet wheel 50 to rotate counterclockwise for a certain angle (see the working states b to c). When the transmission pole 93 of the transmission member 90 is swung upward, the transmission pole 93 drives the detent 70 to rotate counterclockwise about the first pole 11, to make the hook 77 of the detent 70 move away from the ratchet wheel 50 (see the working states c to a). The working states a, b, and c of the waste ink collecting device 8 are continually repeated in order as above mentioned, so that the ratchet wheel 50 is equably rotated. Because the rotation of the ratchet wheel 50 is equable, the waste ink will not fall just on one spot in the annular receiving groove 500, avoiding being piled up.

It is noted that because the first pole 11 is immovable and the transmission pole 93 reciprocatingly moves, a distance between the transmission pole 93 and the first pole 11 is not fixed. Therefore, the first hole 791 and the second hole 792 are needed to be defined for the transmission pole 93 sliding along the first hole 791 and the immovable first pole 11 relatively sliding along the second hole 792, so as to fit the unfixed distance between the transmission pole 93 and the first pole 11. Because the second pole 12 is immovable as the first pole 11, one purpose of the third hole 793 is to fit an unfixed distance between the transmission pole 93 and the second pole 12. Because the detent 70 is rotatable about the first pole 11, another purpose of the definition of the third hole 793 having the width greater than the diameter of the second pole 12 is to allow the rotation of the detent 70.

It is to be understood, however, that even though numerous characteristics and advantages of the disclosure have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A waste ink collecting device for a printer, the waste ink collecting device comprising:

a ratchet wheel defining a receiving groove to receive waste ink;

a detent comprising a main body, and a hook, wherein the main body defines an elongated first hole, an elongated second hole, and an elongated third hole, the second hole is between the first hole and the third hole, the hook extends from an end of the main body away from the first hole;

a reciprocatingly movable transmission pole extending into the first hole to drive the detent;

an immovable first pole extending into the second hole, wherein a diameter of the first pole equals to a width of the second hole; and an immovable second pole extending into the third hole, wherein a diameter of the second pole is smaller than a width of the third hole;

wherein when the transmission pole moves forward, the hook of the detent is driven to engage with the ratchet wheel and drive the ratchet wheel to rotate for a certain angle, and when the transmission pole moves backward, the hook is driven to move away from the ratchet wheel.

2. The waste ink collecting device of claim 1, wherein a lengthwise direction of the third hole is parallel with a lengthwise direction of the second hole, a lengthwise direction of the first hole is angled with the lengthwise direction of the second hole.

3. The waste ink collecting device of claim 2, wherein an angle between the lengthwise direction of the first hole and the lengthwise direction of the second hole is an obtuse angle.

4. The waste ink collecting device of claim 3, wherein the third hole is aligned with the second hole.

5. The waste ink collecting device of claim 4, wherein the main body of the detent comprises an elongated first block, and an elongated second block extending from an end of the first block, the first hole is defined in the first block along a lengthwise direction of the first block, the second hole and the third hole are defined in the second block along a lengthwise direction of the second block, the hook extends from the second block.

6. The waste ink collecting device of claim 1, wherein the receiving groove of the ratchet wheel is annular and defined around an axis of the ratchet wheel.

7. A printer comprising:

a frame;

an ink cartridge carrier mounted to the frame; and a waste ink collecting device comprising:

a ratchet wheel rotatably mounted to the frame under the ink cartridge carrier, wherein a receiving groove is defined in the ratchet wheel to receive waste ink, and the receiving groove faces the ink cartridge carrier;

a detent comprising a main body, and a hook, wherein the main body defines an elongated first hole, an elongated second hole, and an elongated third hole, the second hole is between the first hole and the third hole, the hook extends from an end of the main body away from the first hole;

a reciprocatingly movable transmission pole extending into the first hole to drive the detent;

a first pole extending from the frame into the second hole, wherein a diameter of the first pole equals to a width of the second hole; and a second pole extending from the frame into the third hole, wherein a diameter of the second pole is smaller than a width of the third hole;

wherein when the transmission pole moves forward, the hook of the detent is driven to engage with the ratchet wheel and drive the ratchet wheel to rotate for a certain angle, and when the transmission pole moves backward, the hook is driven to move away from the ratchet wheel.

8. The printer of claim 7, further comprising a transmission shaft mounted to the frame over the detent, wherein the transmission shaft is able to do reciprocating rotation, the transmission pole is securely connected to the transmission shaft.

9. The printer of claim 8, wherein a lengthwise direction of the third hole is parallel with a lengthwise direction of the second hole, a lengthwise direction of the first hole is angled with the lengthwise direction of the second hole.

10. The printer of claim 9, wherein an angle between the lengthwise direction of the first hole and the lengthwise direction of the second hole is an obtuse angle.

11. The printer of claim 10, wherein the third hole is aligned with the second hole.

12. The printer of claim 11, wherein the main body of the detent comprises an elongated first block, and an elongated second block extending from an end of the first block, the first hole is defined in the first block along a lengthwise direction of the first block, the second hole and the third hole are defined in the second block along a lengthwise direction of the second block, the hook extends from the second block.

13. The printer of claim 8, wherein the receiving groove of the ratchet wheel is annular and defined around an axis of the ratchet wheel.

* * * * *